US005705312A

United States Patent [19]

Guarrera et al.

[11] Patent Number: 5,705,312

[45] Date of Patent: Jan. 6, 1998

[54] PHOTOGRAPH SYSTEM

[75] Inventors: Donna J. Guarrera, Addlestone, England; Neil C. Mattucci, North Weymouth, Mass.; Avinash C. Mehta, Belmont, Mass.; Lloyd D. Taylor, Lexington, Mass.; John C. Warner, Norwood, Mass.

[73] Assignee: Polaroid Corporation, Cambridge, Mass.

[21] Appl. No.: 755,702

[22] Filed: Nov. 25, 1996

Related U.S. Application Data

[63] Continuation-in-part of Ser. No. 599,296, Feb. 9, 1996, abandoned.

[51] Int. Cl.[6] ..... G03C 8/32; G03C 8/10; G03C 8/18; G03C 5/305

[52] U.S. Cl. ..... 430/218; 430/239; 430/375; 430/376; 430/383; 430/393; 430/446; 430/487; 430/390

[58] Field of Search ..... 430/218, 487, 430/446, 264, 393, 383, 239, 390, 375, 376

[56] References Cited

U.S. PATENT DOCUMENTS

| | | | |
|---|---|---|---|
| 3,146,102 | 8/1964 | Weyerts et al. | 430/218 |
| 3,173,786 | 3/1965 | Green et al. | 430/218 |
| 3,253,915 | 5/1966 | Weyerts et al. | 430/218 |
| 4,486,528 | 12/1984 | Morigaki et al. | 430/218 |
| 4,740,448 | 4/1988 | Kleim | 430/214 |
| 4,879,200 | 11/1989 | Oka | 430/487 |
| 5,384,232 | 1/1995 | Bishop et al. | 430/440 |
| 5,415,969 | 5/1995 | Waterman | 430/213 |

OTHER PUBLICATIONS

J. Koyama et al. "Thermolysis of Oxime O–Allyl Ethers: A New Method for Pyridine Synthesis," Chem. Pharm. Bull. 31(8) 2601–2606 (1983).

*Primary Examiner*—Richard L. Schilling
*Attorney, Agent, or Firm*—Jennifer A. Kispert

[57] ABSTRACT

There is described a photographic system wherein development of an exposed photosensitive element is carried out in the presence of a quaternary pyridinium compound which has a fused 5 - to 12 - member saturated carbocyclic ring attached to the 2 and 3 positions of the pyridine ring.

18 Claims, 1 Drawing Sheet

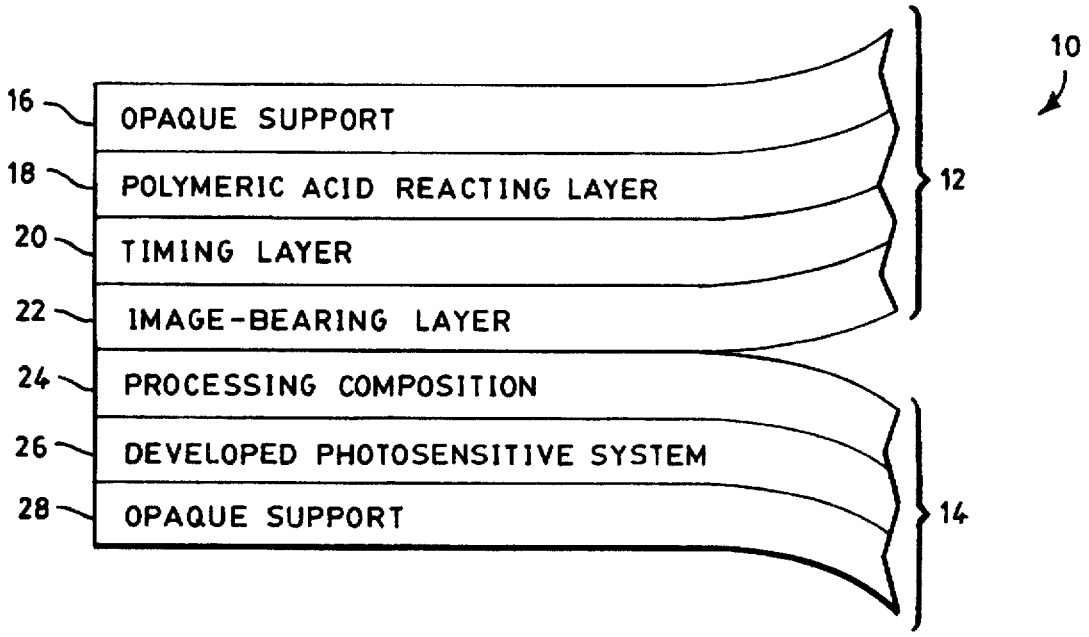
10
16
OPAQUE SUPPORT
18
POLYMERIC ACID REACTING LAYER
20
TIMING LAYER
22
IMAGE-BEARING LAYER
12
24
PROCESSING COMPOSITION
26
DEVELOPED PHOTOSENSITIVE SYSTEM
28
OPAQUE SUPPORT
14

PHOTOGRAPH SYSTEM

CROSS-REFERENCE TO RELATED APPLICATIONS

This application is a continuation-in-part of prior application, Ser. No. 08/599,296 filed Feb. 9, 1996, now abandoned.

BACKGROUND OF THE INVENTION

This application relates to a photographic system, including photographic products and processes, which utilizes certain 2–3 ring substituted quaternary pyridinium compounds.

It is known in the art, as taught by U.S. Pat. No. 3,173,786 that quaternary groups can function as development accelerators in diffusion transfer photographic systems which utilize dye developers as the image dye-providing materials. It is also disclosed that, in such systems, quaternary groups which include a reactive methyl group, i.e., a methyl group which in alkali is capable of forming a methylene base, can also provide improved color isolation, i.e., the transfer of the dye developers is more closely controlled by the silver halide emulsion with which each is associated. Among the compounds disclosed in aforementioned U.S. Pat. No. 3,173,786 as being useful for this purpose are those which are substituted in the 2-position with a methyl group.

U.S. Pat. No. 3,146,102 discloses a photographic multicolor diffusion transfer process which utilizes dye developers. The diffusion transfer processes described therein are carded out in the presence of certain substantially colorless onium compounds which are heterocyclic quaternary ammonium compounds capable of forming methylene bases in alkaline solution. The compounds disclosed in aforementioned U.S. Pat. No. 3,146,102 as being useful for this purpose include those which are substituted in the 2-position with a methyl group. Also mentioned is 2-ethyl-1-phenethylpyridinium bromide.

U.S. Pat. No. 3,253,915 also discloses photographic diffusion transfer photographic film units which utilize dye developers and wherein development of the exposed film unit is carded out in the presence of heterocyclic quaternary ammonium compounds which are capable of forming diffusible methylene bases in alkaline processing compositions. Also disclosed are 2-ethyl-1-phenethylpyridinium bromide and 2-isopropyl-1-phenethylpyridinium bromide.

While such quaternary compounds have been found to provide advantageous results as are described in the above-mentioned patents, nevertheless their performance in some photographic systems is not completely satisfactory. For example, in some diffusion transfer photographic systems, such 2-methyl quaternary compounds have been found to contribute to an undesirable staining phenomenon, i.e., relatively high $D_{min}$ values in the background areas. This phenomenon is thought to be due, at least in part, to the interaction of the quaternary compounds with oxidized hydroquinone developing agents and/or the formation of cyanine dyes due to the ability of the quaternary molecules to couple with each other in alkali in the presence of air, particularly when the photograph is subjected to heating while it is still wet following the development process. The undesirable stain can increase over a period of time thereby adversely affecting the aesthetic qualities of the photograph.

U.S. Pat. No. 5,384,232 discloses a process of developing black and white silver halide elements comprising developing the elements in a developer, in the presence of a development accelerator including pyridinium compounds. The development accelerator may be incorporated into the developer or the silver halide emulsion, but, either way, in contrast to the diffusion transfer photographic system disclosed in the present invention, the photographic system disclosed in the patent describes processing the exposed films in trays containing the developer or in a processor.

It would be desirable to have quaternary compounds which function as development accelerators as well as also providing improved color isolation, and which at the same time have a significantly diminished tendency to contribute to stain in the finished photograph.

SUMMARY OF THE INVENTION

These and other objects and advantages are accomplished in accordance with the invention by providing a photographic system wherein development of an exposed photosensitive element with an aqueous alkaline processing composition is carried out in the presence of a compound represented by the formula

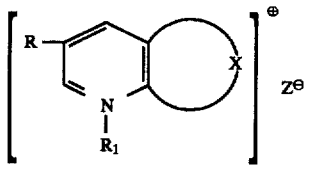

wherein X represents the carbon atoms necessary to complete a substituted or unsubstituted 5 - to 12 - member saturated carbocyclic ring;

R is:

(a) hydrogen;

(b) alkyl having from 1 to 4 carbon atoms; or (c) alkoxy having from 1 to 4 carbon atoms;

$R_1$ is:

(a) alkyl having from 1 to 6 carbon atoms;

(b) alkoxyalkyl having from 2 to 8 carbon atoms which can be represented by

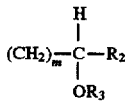

wherein: $R_2$ is hydrogen or alkyl having from 1 to 3 carbon atoms, $R_3$ is alkyl having from 1 to 4 carbon atoms, and m is an integer from 1 to 4;

(c) aryl or alkaryl which can be represented by

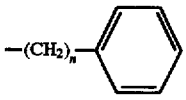

where n is an integer from 0 to 3; or

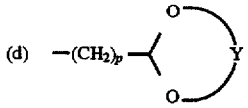

wherein Y represents the carbon atoms necessary to complete a substituted or unsubstituted 5 - or 6 - member heterocyclic moiety, and p is an integer from 1 to 3; and Z is a photographically acceptable counterion such as nitrate ($-NO_3$), halide such as chloride or bromide, sulfonate which may be represented by $R_4$-$SO_3$ wherein $R_4$ is alkyl or aryl, e.g., phenyl or substituted phenyl, such as tosylate and mesylate, and the like.

It has been found that the quaternary compounds utilized according to the invention can minimize or virtually eliminate undesired color formation in the background, i.e., $D_{min}$, areas of a photographic image while functioning as development accelerators and providing improved color isolation, i.e., the transfer of image dye-providing materials is more controlled by the silver halide emulsion with which each is associated.

BRIEF DESCRIPTION OF THE DRAWING

For a better understanding of the invention as well as other objects and other features thereof, reference is made to the following detailed description of various preferred embodiments thereof taken in conjunction with the accompanying drawing wherein the figure is a partially schematic, cross-sectioned view of one embodiment of a film unit according to the invention.

DESCRIPTION OF THE PREFERRED EMBODIMENTS

A preferred group of compounds for use according to the invention has a six - member cyclic ting fused to the pyridine ring and is represented by the formula

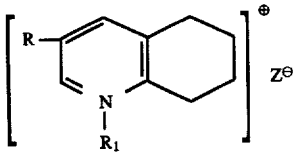

wherein R, $R_1$, and Z are as previously defined.

A particularly preferred group of compounds for use according to the invention has a seven - member cyclic ring fused to the pyridine ring and is represented by the formula

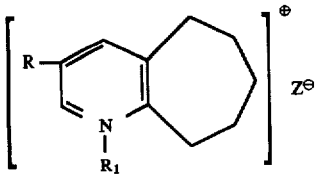

wherein R, $R_1$, and Z are as previously defined.

Another particularly preferred group of compounds for use according to the invention has an eight - member cyclic ring fused to the pyridine ring and is represented by the formula

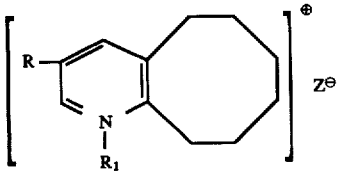

wherein R, $R_1$, and Z are as previously defined.

Another particularly preferred group of compounds for use according to the invention has a twelve - member cyclic ring fused to the pyridine ring and is represented by the formula

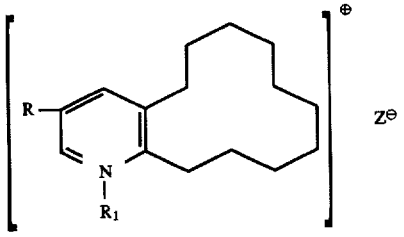

wherein R, $R_1$, and Z are as previously defined.

Specific preferred compounds within the six -, seven - , eight - and twelve - member groups are listed in TABLE I.

TABLE I

| COMPOUND | R | $R_1$ | Z |
|---|---|---|---|
| 1 | H | benzyl | bromide |
| 2 | H | dioxanylethyl | bromide |
| 3 | H | ethyl | tosylate |
| 4 | H | ethyl | bromide |
| 5 | H | ethyl | mesylate |

The quaternary compounds utilized according to the invention may be prepared according to reactions which are well known by those skilled in the art and such reactions will be particularly apparent from the detailed descriptions of the preparation of various specific quaternary compounds which are provided in the Examples.

Generally, the quaternary compounds are prepared by reacting the appropriate quaternizing agent such as benzyl bromide, dioxanylethyl bromide, ethyl tosylate or ethyl mesylate with the appropriate heterocyclic base such as cyclopentenopyridine, cyclohexenopyridine, cycloheptenopyridine, cyclododecenopyridine, etc. The cycloalkenopyridines which may be used to synthesize the compounds of the present invention can be synthesized from the appropriate ring-size cyclic ketones using synthetic procedures described in the art, such as, for example, in *Chem. Pharm. Bull.* 31(8):2601–2606 (1983). In addition, cyclopentenopyridine, cyclohexenopyridine, cycloheptenopyridine and cyclododecenopyridine are commercially available from, for example, Aldrich (Milwaukee, Wis.).

These quaternary compounds may be used in the photographic processing of any exposed photosensitive elements and in any amount which is required to accomplish their intended purpose. The mount necessary in any specific instance is dependent upon a number of factors such as, for example, the specific quaternary compound utilized, the type of photosensitive element and the result desired. Routine scoping tests may be conducted to ascertain the concentration which is appropriate for any given photographic element. According to a preferred embodiment there are provided according to the invention diffusion transfer photographic film units as will be discussed more in detail below herein. In such diffusion transfer photographic film units the quaternary compounds are preferably incorporated in the photographic processing composition which is typically enclosed in a rupturable container as is known in the art. It should be noted here, however, that the quaternary compounds of the invention may be incorporated in other locations in the diffusion transfer film units such as, for example, in the photosensitive and image-receiving elements.

The quaternary compounds may be used during photographic processing of any exposed photosensitive element including photographic systems for forming images in black and white or in color and those wherein the final image is a metallic silver image or one formed by other image-forming materials.

The quaternary compounds may be used in conjunction with any photographic emulsion. In the preferred diffusion transfer film units of the invention, it is preferred to include a negative working silver halide emulsion, i.e., one which develops in the areas of exposure. Further, these compounds may be used in association with any image dye-providing materials. In a particularly preferred embodiment the diffusion transfer photographic film elements of the invention include one or more image dye-providing materials which may be initially diffusible or nondiffusible. In diffusion transfer photographic systems the image dye-providing materials which can be utilized generally may be characterized as either (1) initially soluble or diffusible in the processing composition but which are selectively rendered nondiffusible imagewise as a function of development; or (2) initially insoluble or nondiffusible in the processing composition but which selectively provide a diffusible product imagewise as a function of development. The image dye-providing materials may be complete dyes or dye intermediates, e.g., color couplers. The requisite differential in mobility or solubility may be obtained, for example, by a chemical reaction such as a redox reaction, a coupling reaction or a cleavage reaction. In a particularly preferred embodiment of the invention the image dye-providing materials are dye-developers which are initially diffusible materials. The dye developers contain, in the same molecule, both the chromophoric system of a dye and a silver halide developing function as is described in U.S. Pat. No. 2,983,606.

Other image dye-providing materials which may be used include, for example, initially diffusible coupling dyes such as are useful in the diffusion transfer process described in U.S. Pat. No. 2,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or those which undergo silver assisted cleavage to release a diffusible dye in accordance with the disclosure of U.S. Pat. No. 3,719,489; and initially nondiffusible image dye-providing materials which release a diffusible dye following coupling with an oxidized color developer as described in U.S. Pat. No. 3,227,550.

Preferred diffusion transfer film units according to the invention include, as image dye-providing materials, both dye developers and dye-providing thiazolidine compounds as described in U.S. Pat. No. 4,740,448.

Particularly preferred diffusion transfer photographic film units according to the invention are those intended to provide multicolor dye images. The most commonly employed photosensitive elements for forming multicolor images are of the "tripack" structure and contain blue-, green- and red-sensitive silver halide emulsion layers each having associated therewith in the same or a contiguous layer a yellow, a magenta and a cyan image dye-providing material, respectively. Suitable photosensitive elements and their use in the processing of diffusion transfer photographic images are well known and are disclosed, for example, in U.S. Pat. Nos. 2,983,606; 3,345,163; and 4,322,489. Further, the diffusion transfer film units according to the invention may be those wherein an image-receiving element is designed to be separated from the photosensitive element after photographic processing has been completed—the so-called "peel-apart" type—or the film units may be of the so-called "integral" type where the entire film unit is maintained together.

Referring now to the figure there is illustrated a preferred embodiment of a photographic diffusion transfer film unit 10 wherein the image-receiving element 12 is designed to be separated from the photosensitive element 14 after photographic processing. The film unit is shown after photographic processing and prior to the separation of the image-receiving element 12 from the processed photosensitive element 14.

Image-receiving element 12 as shown comprises a support 16 carrying a polymeric acid-reacting layer 18, a timing (or spacer) layer 20 and an image-bearing layer 22. Each of the layers carried by support 16 functions in a predetermined manner to provide desired diffusion transfer photographic processing as is known in the art. It should also be understood that the image-receiving element may include additional layers such as a strip-coat layer and an overcoat layer as is known in the art.

Support material 16 can comprise any of a variety of materials capable of carrying the other layers of image-receiving element 12. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, the nature of support material 16 as a transparent, opaque or translucent material will be a matter of choice. Typically, an image-receiving element adapted to be used in peel-apart diffusion transfer film units and designed to be separated after processing will be based upon an opaque support material 16. While support material 16 of image-receiving element 12 will preferably be an opaque material for production of a photographic reflection print, it will be appreciated that support 16 will be a transparent support material where the processing of a photographic transparency is desired. In one embodiment where support material 16 is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer 22 can be viewed as a transparency. In another embodiment where support material 16 is a transparent sheet, opacification materials such as carbon black and titanium dioxide can be incorporated in the processing composition to permit in-light development.

As shown, film unit 10 includes a photoexposed photosensitive element 14 comprising a processing composition layer 24, a developed photosensitive system 26 and an opaque support 28. The film unit 10 is shown after photographic processing and prior to separation of the image-receiving element 12 from the processed photosensitive element 14. Prior to processing the aqueous alkaline processing composition 24 is typically contained within a pressure-rupturable container, or pod, as is common in the art. Such pods and like structures are common in the art and generally define the means for providing the processing composition to the photosensitive element and image-receiving element. The processing composition typically comprises an aqueous alkaline composition which may include a silver halide developing agent and other addenda as is known in the art. Examples of such processing compositions are found in U.S. Pat. Nos. 3,445,685; 3,597,197; 4,680,247; 4,756,996; and 5,422,233 as well as the patents cited therein. The processing composition utilized in the diffusion transfer film units of the invention preferably includes one or more of the quaternary pyridinium compounds described above.

The photosensitive system 26 comprises a photosensitive silver halide emulsion. In a preferred color embodiment of the invention a corresponding image dye-providing material is provided in conjunction with the silver halide emulsion. The image dye-providing material is capable of providing, upon processing, a diffusible dye which is capable of diffusing to the image-bearing layer 22 as a function of exposure. As described previously, preferred photographic diffusion transfer film units are intended to provide multicolor dye images and the photosensitive element 14 is preferably one capable of providing such multicolor dye images. In a preferred black and white embodiment, the image-forming material utilized is complexed silver which diffuses from the photosensitive element to the image-receiving layer during processing. Both such photosensitive systems are well known in the art.

As illustrated, the image-receiving element 12 includes a polymeric acid-reacting layer 18. The polymeric acid-reacting layer 18 reduces the environmental pH of the film unit, subsequent to transfer image formation. As disclosed, for example, in aforementioned U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and polymeric acid-reacting layer 18 which comprises immobilized acid-reactive sites and which functions as a neutralization layer. Preferred polymers for polymeric acid-reacting layer 18 comprise such polymeric acids as cellulose acetate hydrogen phthalate; polyvinyl hydrogen phthalate; polyacrylic acid; polystyrene sulfonic acid; and maleic anhydride copolymers and half esters thereof.

Polymeric acid-reacting layer 18 can be applied, if desired, by coating support layer 16 with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of polymeric acid-reacting layer 18 comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in aforementioned U.S. Pat. Nos. 3,362,819 and 3,756,815, mention may be made of those disclosed in U.S. Pat. Nos. 3,765,885; 3,819,371; 3,833,367; and 3,754,910.

Timing layer 20 controls the initiation and the rate of capture of alkali by the acid-reacting polymer layer 18. The timing layer 20 may be designed to operate in a number of ways. For example, the timing layer 20 may act as a sieve, slowly metering the flow of alkali there through. Alternatively, the timing layer 20 may serve a "hold and release" function; that is, the timing layer 20 may serve as an alkali impermeable barrier for a predetermined time interval before converting in a rapid and quantitatively substantial fashion to a relatively alkali permeable condition, upon the occurrence of a predetermined chemical reaction. Examples of suitable materials for use as timing layers are described in U.S. Pat. Nos. 3,575,701; 4,201,587; 4,288,523; 4,297,431; 4,391,895; 4,426,481; 4,458,001; 4,461,824; and 4,547,451. As described in these patents, timing layers having the previously described characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layer 20 will typically be copolymers comprising repeating units of the previously described type (i.e., repeating units derived from polymerizable monomers capable of undergoing an alkali-initiated chemical reaction after a predetermined "hold" time interval) and comonomeric units incorporated into the polymer to impart thereto predetermined properties. For example, the "hold time", i.e., the time interval during which timing layer 20 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 20 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymeric to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 20, thereby altering the time necessary for initiation of the desired and predetermined chemical reaction. This latter means of adjusting the hold time of timing layer 20 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 20 and, thus, a longer hold time, may be obtained by increasing the hydrophobicity of the matrix polymer or increasing the degree of coalescence.

Examples of suitable comonomers which can be used in the production of copolymeric materials suited to application in timing layer 20 include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl) acrylamide; N-isopropyl acrylamide; N-(β-hydroxy ethyl) acrylamide, N-(β-dimethylaminoethyl)acrylamide; N-(t-butyl)acrylamide; N-[β-(dimethylamino)ethyl] methacrylamide; 2-[2'-(acrylamido)ethoxy]ethanol; N-(3'-methoxypropyl)acrylamide; 2-acrylamido-3-methol butyramide; acrylamido acetamide; methacrylamido acetamide; 2-[2-methacrylamido-3'-methyl butyramido] acetamide; and diacetone acrylamide.

Matrix polymer systems adapted to utilization in timing layer 20 can be prepared by physical mixing of the matrix polymer and the polymer containing the repeating units capable of undergoing alkali-initiated chemical reaction, or by the preparation of the timing layer polymer in the presence of a pre-formed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in timing layer 20 of polymer or other materials which adversely affect or negate the desired alkali impermeable barrier properties of timing layer 20 is to be avoided. In this connection, it should be noted that gelatin, and particularly unhardened gelatin, is readily swollen and permeated by aqueous alkaline compositions typically employed in photographic processing. Accordingly, the presence in a timing layer of the invention of amounts of gelatin or other materials which promote rapid permeation of the layer by alkali and which effectively negate the hold character of the layer are to be avoided. Timing layer 20 is typically applied as a water-impermeable layer which results from the coalescence and drying of a coating composition, e.g., a latex composition.

The image-bearing layer 22 is designed for receiving an image-forming material which diffuses in an imagewise manner from the photosensitive element during processing. In color embodiments of the present invention, the image-bearing layer 22 generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061. Another image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346. Other materials can, however, be employed. Suitable mordant materials of the vinylbenzyltrialkyl-ammonium type are described, for example, in U.S. Pat. Nos. 3,770,439 and 4,794,067. Mordant polymers of the hydrazinium type (such as polymeric mordants prepared by quaternization of polyvinylbenzyl chloride with a disubstituted asymmetric hydrazine) can be employed. Such mordants are described in Great Britain Patent No. 1,022,207, published Mar. 9, 1966. One such hydrazinium mordant is poly(1-vinylbenzyl 1,1-dimethylhydrazinium chloride) which, for example, can be admixed with polyvinyl alcohol for provision of a suitable image-receiving layer.

In black and white embodiments of the invention, the image-forming material utilized is complexed silver which diffuses from the photosensitive element to the image-receiving layer during processing. The image-receiving layer utilized in such black and white embodiments typically includes silver nucleation materials, as is well known in the art.

As noted previously the image-receiving element 12 may include other layers such as a strip-coat layer which is designed to facilitate the separation of the image-receiving element 12 from the photosensitive element 14. Many materials have been disclosed in the art for use in strip-coat layers. Typical suitable strip-coat materials are described in U.S. Pat. Nos. 4,009,031 and 5,346,800.

The image-receiving element may also include an overcoat layer as described in U.S. Pat. No. 5,415,969, and in copending, commonly-assigned application, Ser. No. 08/672,499 filed Jun. 28, 1996 now U.S. Pat. No. 5,633,114 which is a file wrapper continuation of continuation-in-part application, Ser. No. 08/382,880 filed Feb. 2, 1995 (now abandoned) wherein water-insoluble particles are provided in a binder material. Such an overcoat layer comprises a majority by dry weight of water-insoluble particles and a minority by dry weight of a binder material. The particles are substantially insoluble in water and non-swellable when wet. Furthermore, in order to minimize any light scatter by the overcoat layer, the particles typically have a small average particle size, for example, less than 300 mm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in such an overcoat layer, however, other inorganic particles may be used in combination or substituted therefor.

The binder material for the overcoat layer preferably comprises a water-insoluble latex material, however, the layer may comprise water soluble materials or combinations of water-insoluble and water soluble materials. Examples of applicable water soluble binder materials include ethylene acrylic acid, polyvinyl alcohol, gelatin, and the like.

One or more overcoat layers may be used in combination with other layers. Typically, each overcoat layer has a thickness of up to about 2 microns, and preferably between 1 and 1.5 microns. Such overcoat layers must allow sufficient image-providing material to be transferred to image-receiving layer to provide a photograph of the desired quality. Furthermore, since the overcoat layer(s) remain upon the image-receiving element after processing and separation from the photosensitive element, the overcoat layer(s) should not scatter visible light to any appreciable degree since the photograph will be viewed through such layer(s).

As noted previously, the photographic diffusion transfer film units according to the invention include black and white photographic film units. In such embodiments, a photosensitive element including a photosensitive silver halide emulsion is exposed to light and subjected to an aqueous alkaline solution comprising a silver halide developing agent and a silver halide solvent. The developing agent reduces exposed silver halide to form insoluble and the unexposed silver halide, solubilized by the silver solvent, migrates to an image-receiving element. The image-receiving element typically comprises a support and an image-receiving layer including a silver precipitating material wherein the soluble silver complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,390,991; 3,567,442; and 3,607,269 and in E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I 2,3-Cyclohexenopyridine (13.3 g, 0.1 mol) and benzyl bromide (17.1 g, 0.1 mol) in 30 mL acetonitrile were heated at reflux under nitrogen with stirring for 16 hours. The reaction mixture was allowed to cool to room temperature and then diluted with 100 mL toluene and 50 mL ether with stirring. The solid which precipitated from solution was collected by filtration, washed with toluene followed by ether and hexane and dried in a vacuum oven at 50° C. to give 27.76 g (91.25% yield) of the product, N-benzyl-2,3-cyclohexenopyridinium bromide

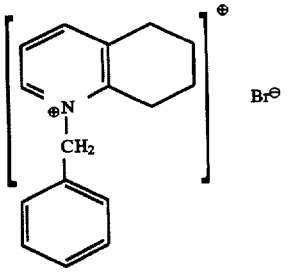

m.p. 108° to 110° C.

The $^{13}C$ nmr and $^{1}H$ nmr spectra were consistent with the structure of the desired product.

EXAMPLE II 2,3-Cyclohexenopyridine (13.3 g, 0.1 mol) and 2-(2-bromoethyl)-1,3-dioxane (21.5 g, 0.11 mol) in 50 mL acetonitrile were heated at reflex under nitrogen with stirring for 24 hours. The heterogeneous reaction mixture was cooled in an ice bath. Some scratching with a glass rod resulted in the separation of a solid which was collected by filtration, washed with ethyl acetate followed by hexane and dried in a vacuum oven at 50° C. to give 28.1 g (85.62% yield) of product, N[2-(1, 3-dioxanyl)ethyl]-2,3-cyclohexenopyridinium bromide

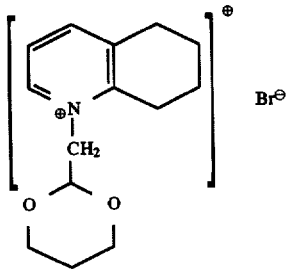

m.p. 95°–97° C.

The $^{13}C$ nmr and $^{1}H$ nmr spectra were consistent with the structure of the desired product.

EXAMPLE III 2,3-Cyclohexenopyridine (76.68 g, 0.576 mol) and ethyl tosylate (115.26 g, 0.576 mol) in 150 mL acetonitrile were heated at reflux for 10 hours. To the resulting solution, cooled in an ice bath, there was added approximately 400 mL of ethyl acetate to precipitate a white solid. The product was collected by vacuum filtration and washed with ethyl acetate to give 174.5 g (91% yield) of a white solid N-ethyl-2,3-cyclohexenopyridinium tosylate

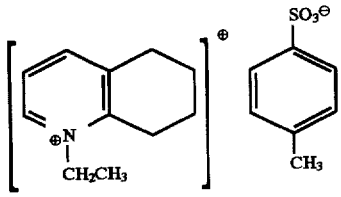

m.p. 86°–88° C.

The $^{13}C$ nmr and $^{1}H$ nmr spectra were consistent with the structure of the desired product.

EXAMPLE IV 2,3-Cyclopentenopyridine (10.18 g, 0.085 mol) and ethyl tosylate (16.96 g, 0.085 mol) in 40 mL acetonitrile were heated at reflux for 10 hours. To the resulting solution, cooled in a dry ice bath, there was added approximately 60 mL of ethyl acetate to precipitate a white solid. The product was collected by vacuum filtration and washed with ethyl acetate to give 24.7 g (91% yield) of N-ethyl-2,3-cyclopentenopyridinium tosylate

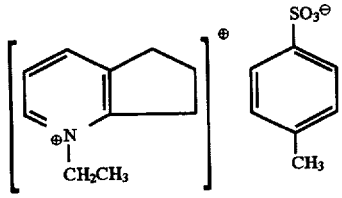

m.p. 102°–105° C.

The $^{13}C$ nmr and $^{1}H$ mnr spectra were consistent with the structure of the desired product.

EXAMPLE V 2,3-Cyclododecenopyridine (75.0 g, 0.345 mol) and ethyl tosylate (71.1 g, 0.355 mol) in 400 mL acetonitrile were heated at reflux for 13 hours. To the resulting solution, cooled in a dry ice bath, there was added approximately 400 mL of ethyl acetate to precipitate a white solid. The product was collected by vacuum filtration, washed with ethyl acetate and dried under vacuum to give 86.1 g (59.8% yield) of N-ethyl-2,3-cyclododecenopyridinium tosylate

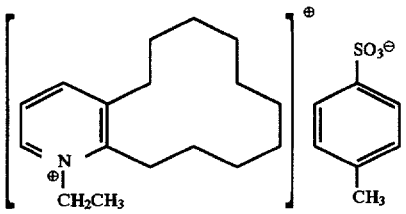

m.p. 142°–143° C.

The $^{13}C$ nmr and $^{1}H$ nmr spectra were consistent with the structure of the desired product.

EXAMPLE VI

Several diffusion transfer photographic film units were prepared which included control film units (Ctrl-1, Ctrl-2) and film units according to the invention (A, B). All of the film units had identical image-receiving elements and photosensitive elements. As will be described in detail below, the processing compositions used for the control film units included a prior art quaternary pyridinium compound whereas the film units according to the invention included a quaternary pyridinium compound according to the invention.

The image-receiving elements used in all the film units comprised a white-pigmented polyethylene coated opaque photographic film support having coated thereon in succession:

1. a polymeric acid-reacting layer coated at a coverage of about 21,528 mg/m$^2$ comprising a 1.2/1 ratio of AIRFLEX™ 465 (a vinyl acetate ethylene latex from Air Products Co.) and GANTREZ™ S-97 (a free acid of a copolymer of methyl vinyl ether and maleic anhydride from GAF Corp.);

2. a timing layer coated at a coverage of about 6351 mg/m$^2$ comprising 3 parts of a copolymer of diacetone acrylamide and acrylamide grafted onto polyvinyl alcohol and 1 part of an aqueous polymeric emulsion;

3. an image-receiving layer coated at a coverage of about 3229 mg/m$^2$ of a 2/1.25 ratio of a copolymer of vinylbenzyltrimethylammonium chloride, vinylbenzyltriethylammonium chloride and vinylbenzyldimethyldodecylammonium chloride (6.7/3.3/1, respectively) and AIRVOL™ 425 (a polyvinyl alcohol from Air Products Co.); and 4. a strip coat layer coated at a coverage of about 162 mg/m$^2$ comprising about 40% by weight of a terpolymer of acrylic acid, hydroxypropyl methacrylate and 4-vinylpyrrolidone and about 60% by weight of carboxymethyl An image-receiving element including the strip-coat layer described above is described and claimed in copending, commonly-assigned U.S. patent application, Ser. No. 08/568,937 filed Dec. 7, 1995 U.S. Pat. No. 5,591,560.

The photosensitive element utilized in all the film units comprised an opaque subcoated polyethylene terephthalate photographic film base carrying in succession:

1. a layer coated at a coverage of about 19 mg/m$^2$ of sodium cellulose sulfate and about 2 mg/m$^2$ of gelatin;

2. a cyan dye developer layer comprising about 807 mg/m$^2$ of the cyan dye developer represented by the formula

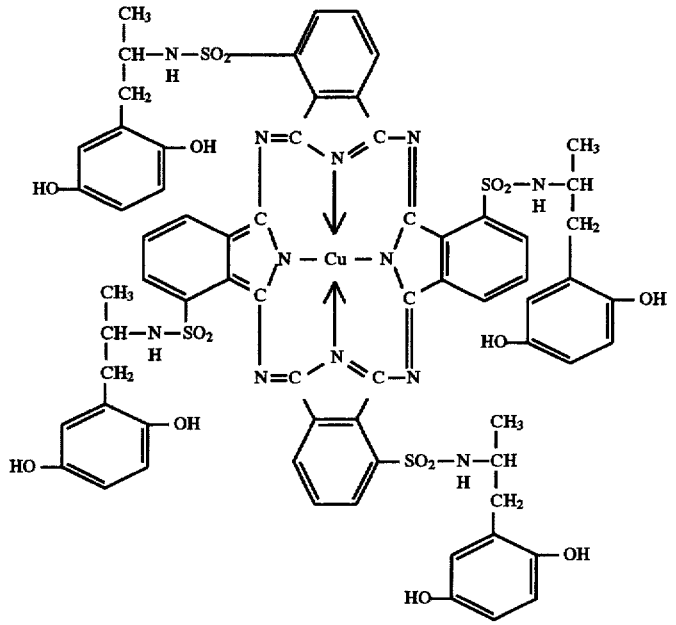

about 436 mg/m$^2$ of gelatin, about 10 mg/m$^2$ of zinc bis (6-methylaminopurine) and about 150 mg/m$^2$ of bis-2,3-(acetamidomethylnorbornyl) hydroquinone ("AMNHQ").

3. a red-sensitive silver iodobromide layer comprising about 612 mg/m$^2$ of silver iodobromide (0.7 micron), about 418 mg/m$^2$ of silver iodobromide (1.55 micron) and about 514 mg/m$^2$ of gelatin;

4. an interlayer comprising about 2325 mg/m$^2$ of a copolymer of butyl acrylate/diacetone acrylamide/methacrylic acid/styrene/acrylic acid, about 97 mg/m$^2$ of polyacrylamide, about 124 mg/m$^2$ of dantoin and about 3 mg/m$^2$ of succindialdehyde;

5. a magenta dye developer layer comprising about 374 mg/m$^2$ of a magenta dye developer represented by the formula

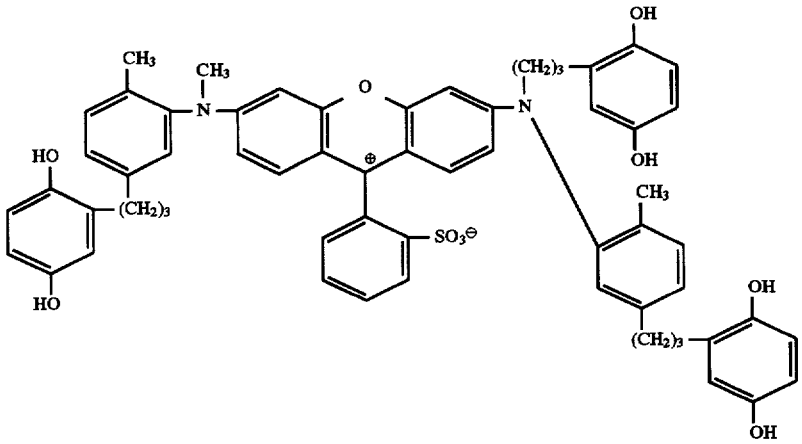

about 310 mg/m$^2$ of gelatin and about 400 mg/m$^2$ of 2-phenyl benzimidazole;

6. a spacer layer comprising about 250 mg/m$^2$ of carboxylated styrenebutadiene latex (Dow 620 latex), about 310 mg/m$^2$ of gelatin and about 20 mg/m$^2$ of a cyan filter dye;

7. a green-sensitive silver iodobromide layer comprising about 189 mg/m$^2$ of silver iodobromide (0.5 micron), about 142 mg/m$^2$ of silver iodobromide (0.6 micron), about 567 mg/m$^2$ of silver iodobromide (1.1 micron) and about 415 mg/m$^2$ of gelatin;

8. a layer comprising about 100 mg/m$^2$ of AMNHQ, about 30 mg/m$^2$ of bis(6-methylaminopurine) about 200 mg/m$^2$ of 6-hydroxy-4,4,-5,7,8-pentamethyl-3,4-dihydrocoumarin and about 135 mg/m$^2$ of gelatin;

9. an interlayer comprising about 1448 mg/m$^2$ of the copolymer described in layer 4, about 76 mg/m$^2$ of polyacrylamide and about 4 mg/m$^2$ of succindialdehyde;

10. a layer comprising about 1100 mg/m$^2$ of a scavenger, 1-octadecyl-4,4-dimethyl-2-[2-hydroxy-5-(N-(7-caprolactamido)sulfonamido] thiazolidine and about 440 mg/m$^2$ of gelatin;

11. a yellow filter layer comprising about 260 mg/m$^2$ of benzidine yellow dye and about 104 mg/m$^2$ of gelatin;

12. a yellow image dye-providing layer comprising about 960 mg/m$^2$ of a yellow image dye-providing material represented by the formula

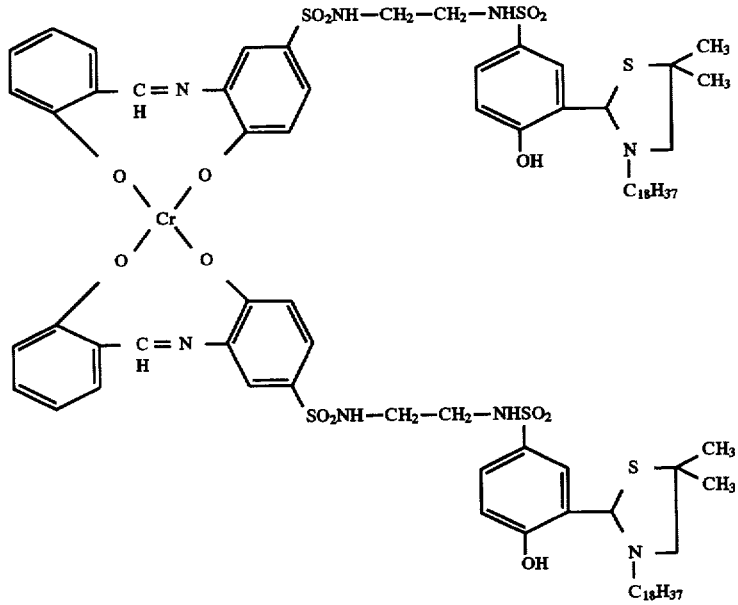

and about 384 mg/m$^2$ of gelatin;

13. a layer coated at a coverage of about 850 mg/m$^2$ of a hydrogen-bonded complex of norbornyltertiarybutyl hydroquinone and dimethylterephthalamide, 25 mg/m$^2$ of 5-t-butyl-2,3-bis[(1-phenyl-1H-tetrazol-5-yl)thio]-1,4-benzenediol bis [(2-methanesulfonylethyl)carbamate] and about 350 mg/m$^2$ of gelatin;

14. a blue-sensitive silver iodobromide layer comprising about 29 mg/m$^2$ of silver iodobromide (0.9 micron), about 130 mg/m$^2$ of silver iodobromide (1.2 micron), about 130 mg/m$^2$ of silver iodobromide (2.1 micron) and about 144 mg/m$^2$ of gelatin;

15. a layer comprising about 1150 mg/m$^2$ of an ultraviolet filter material, Tinuvin (Ciba-Geigy), about 100 mg/m$^2$ of ditertiarybutyl hydroquinone (DTBHQ), about 35 mg/m$^2$ of benzidine yellow dye and about 134 mg/m$^2$ of gelatin; and 16. a topcoat layer comprising about 204 mg/m$^2$ of colloidal silica (Nyacol 1430LS), about 51 mg/m$^2$ of the copolymer described in layer 4 and about 22 mg/m$^2$ of polyacrylamide.

Diffusion transfer photographic film units which can include the dihydrocoumarin compound in layer 7 and the DTBHQ in layer 15 are described and claimed in U.S. Pat. No. 5,571,656.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the base aqueous alkaline processing composition utilized for the processing of the film units is set forth in Table II.

TABLE II

| COMPONENT | PARTS BY WEIGHT |
|---|---|
| hypoxanthine | 0.98 |
| 1-methylimidazole | 0.29 |
| p-toluenesulfinate, sodium salt | 0.49 |
| guanine | 0.15 |
| potassium hydroxide | 8.69 |
| p-hydroxyphenylmercaptotetrazole | 0.005 |
| boric acid | 0.85 |
| bis-6-methylaminopurine | 0.03 |
| titanium dioxide | 0.20 |
| 6-methyluracil | 0.54 |
| pentanolamine | 1.96 |
| hydrophobically-modified hydroxyethylcellulose | 3.36 |
| 1,2,4,-triazole | 0.35 |
| phenylmercaptotetrazole | 0.0006 |
| water | Balance to 100 |

The processing compositions used to process film units Ctrl-1 and Ctrl-2, and film units A and B according to the invention each included the quaternary compound as specified in Table III wherein the amounts of the respective quaternaries represent molar equivalents.

TABLE III

| FILM UNIT | QUATERNARY | CONCENTRATION (g/100 gms of fluid) |
|---|---|---|
| Ctrl-1 | 2-methyl-N-butylpyridinium bromide | 1.45 |
| Ctrl-2 | 2-methyl-N-benzylpyridinium bromide | 1.7 |
| A | N-ethyl-2,3-cyclohexeno-pyridinium tosylate | 2.1 |
| B | N-ethyl-2,3-cyclohexeno-pyridinium bromide | 1.5 |

Each film unit, after exposure to a sensitometric target, was passed through a pair of rollers set at a gap spacing of about 0.0034 inch and after an imbibition period of 90 seconds the photosensitive and image-receiving elements were separated from each other.

Identical film units were processed as described above, and within five seconds after the photosensitive and image-receiving elements were separated from each other, the image-beating element was placed in front of a hot hair drier to simulate extreme drying conditions.

The red, green and blue minimum ($D_{min}$) and maximum ($D_{max}$) reflection densities of both the air dried and the heater dried image-bearing elements, set out in TABLE IV, were read on a MacBeth Densitometer.

TABLE IV

| | | AIR DRIED | | | HEATER DRIED | | |
|---|---|---|---|---|---|---|---|
| | | Red | Green | Blue | Red | Green | Blue |
| Ctrl-1 | $D_{max}$ | 2.27 | 2.14 | 1.75 | — | — | — |
| | $D_{min}$ | 0.10 | 0.13 | 0.09 | 0.15 | 0.25 | 0.22 |
| Ctrl-2 | $D_{max}$ | 2.04 | 1.86 | 1.52 | — | — | — |
| | $D_{min}$ | 0.10 | 0.13 | 0.09 | 0.21 | 0.42 | 0.29 |
| A | $D_{max}$ | 2.22 | 2.10 | 1.71 | — | — | — |
| | $D_{min}$ | 0.10 | 0.13 | 0.10 | 0.10 | 0.13 | 0.13 |
| B | $D_{max}$ | 2.20 | 2.11 | 1.72 | — | — | — |
| | $D_{min}$ | 0.10 | 0.13 | 0.10 | 0.09 | 0.13 | 0.12 |

The data set out in TABLE IV show that the control film units which each included a prior art quaternary compound exhibited a large increase in the red (Ctrl-2), green and blue minimum densities for the heater dried images. The red, green and blue minimum densities of the heater dried film units according to the invention exhibited virtually no increase.

EXAMPLE VII

Several diffusion transfer photographic film units were prepared according to the invention (A', C, D and E) as described in Example VI. The processing compositions used to process film units A', C, D and E each included the quaternary compound as specified in Table V wherein the mounts of the respective quaternaries represent molar equivalents.

TABLE V

| FILM UNIT | QUATERNARY | CONCENTRATION (g/100 gms of fluid) |
|---|---|---|
| A' | N-ethyl-2,3-cyclohexeno-pyridinium tosylate | 2.0 |
| C | N-ethyl-2,3-cyclohepteno-pyridinium tosylate | 2.1 |

TABLE V-continued

| FILM UNIT | QUATERNARY | CONCENTRATION (g/100 gms of fluid) |
|---|---|---|
| D | N-ethyl-2,3-cyclooctenopyridinium tosylate | 2.1 |
| E | N-ethyl-2,3-cyclododecenopyridinium tosylate | 2.5 |

Film units A', C, D and E were processed as described in Example VI. The red, green and blue minimum and maximum reflection densities of both the air dried and the heater dried image-bearing elements are set out in TABLE VI.

TABLE VI

| | | AIR DRIED | | | HEATER DRIED | | |
|---|---|---|---|---|---|---|---|
| | | Red | Green | Blue | Red | Green | Blue |
| A' | $D_{max}$ | 1.90 | 1.90 | 1.64 | — | — | — |
| | $D_{min}$ | 0.10 | 0.12 | 0.10 | 0.10 | 0.13 | 0.14 |
| C | $D_{max}$ | 1.94 | 1.96 | 1.63 | — | — | — |
| | $D_{min}$ | 0.10 | 0.13 | 0.08 | 0.10 | 0.12 | 0.12 |
| D | $D_{max}$ | 1.97 | 1.98 | 1.57 | — | — | — |
| | $D_{min}$ | 0.10 | 0.12 | 0.08 | 0.10 | 0.13 | 0.11 |
| E | $D_{max}$ | 2.04 | 2.07 | 0.57 | — | — | — |
| | $D_{min}$ | 0.10 | 0.13 | 0.09 | 0.10 | 0.13 | 0.13 |

Similar to the data set out in TABLE IV of Example VI above, the data set out in TABLE VI show that the red, green and blue minimum densities of the heater dried film units according to the invention exhibit virtually no increase when compared to their air dried counterparts. It is apparent that the blue $D_{max}$ of film unit E was very low. It is thought that this result is due to interactions between the quaternary compound which has a twelve - member saturated carbocyclic ring and other photographic reagents of the invention, such as, for example, the thiazolidine image dye-providing material.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A photographic method comprising the steps of exposing a photosensitive element which contains at least one silver halide emulsion layer in association with an image dye-providing material and developing said exposed photosensitive element with an aqueous alkaline processing composition in the presence of a quaternary pyridinium compound represented by the formula

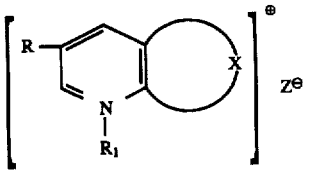

wherein:

X represents the carbon atoms necessary to complete a 5 - to 12 - member saturated carbocyclic ring;

R is hydrogen, alkyl having from 1 to 4 carbon atoms or alkoxy having from 1 to 4 carbon atoms;

$R_1$ is alkyl having from 1 to 6 carbon atoms, alkoxyalkyl having from 2 to 8 carbon atoms represented by

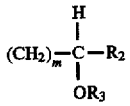

wherein: $R_2$ is hydrogen or alkyl having from 1 to 3 carbon atoms, $R_3$ is alkyl having from 1 to 4 carbon atoms, and m is an integer from 1 to 4, aryl or alkaryl represented by

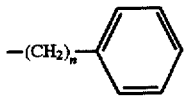

where n is an integer from 0 to 3; or

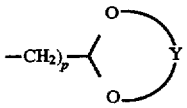

wherein: Y represents the carbon atoms necessary to complete a 5 - or 6 - member heterocyclic moiety, and p is an integer from 1 to 3; and Z is a photographically acceptable counterion, whereby an image is formed.

2. The method as defined in claim 1 wherein said photosensitive element comprises a support carrying:

(a) said silver halide emulsion layer;

(b) a second sheet-like element which is superposed or superposable on said photosensitive element;

(c) an image-receiving layer positioned in one of said photosensitive or second sheet-like elements; and (d) a rupturable container releasably holding said aqueous alkaline processing composition and so positioned as to be adapted to distribute said aqueous alkaline processing composition between predetermined layers of said elements.

3. The method as defined in claim 1 wherein said photosensitive element comprises a red-sensitive silver halide emulsion layer in association with a cyan image dye-providing material, a green-sensitive silver halide emulsion layer in association with a magenta image dye-providing material and a blue-sensitive silver halide emulsion layer in association with a yellow image-dye providing material.

4. The method as defined in claim 1 wherein said quaternary pyridinium compound is initially present in said aqueous alkaline processing composition.

5. The method as defined in claim 1 wherein said quaternary pyridinium compound is represented by the formula

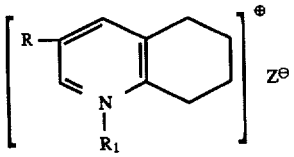

wherein R, $R_1$, and Z are as previously defined.

6. The method as defined in claim 1 wherein said quaternary pyridinium compound is represented by the formula

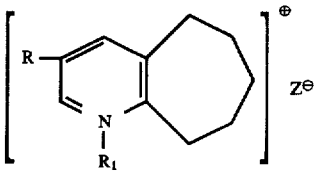

wherein R, $R_1$, and Z are as previously defined.

7. The method as defined in claim 1 wherein $R_1$ is $C_2H_5$.

8. The method as defined in claim 7 wherein Z is

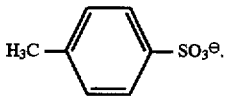

9. A diffusion transfer photographic film unit comprising (a.) a photosensitive element comprising a support carrying at least one silver halide emulsion layer;

(b.) a second sheet-like element which is superposed or superposable on said photosensitive element;

(c.) an image-receiving layer positioned in one of said photosensitive or second sheet-like elements;

(d.) a rupturable container releasably holding an aqueous alkaline processing composition and so positioned as to be adapted to distribute said aqueous alkaline processing composition between predetermined layers of said elements; and (e.) a quaternary pyridinium compound represented by the formula

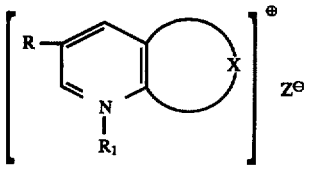

wherein:

X represents the carbon atoms necessary to complete a 5 - to 12 - member saturated carbocyclic ring;

R is hydrogen, alkyl having from 1 to 4 carbon atoms or alkoxy having from 1 to 4 carbon atoms;

$R_1$ is alkyl having from 1 to 6 carbon atoms, alkoxyalkyl having from 2 to 8 carbon atoms represented by

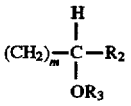

wherein: $R_2$ is hydrogen or alkyl having from 1 to 3 carbon atoms, $R_3$ is alkyl having from 1 to 4 carbon atoms, and m is an integer from 1 to 4, aryl or alkaryl represented by

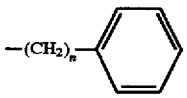

where n is an integer from 0 to 3; or

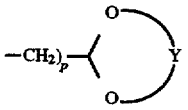

wherein: Y represents the carbon atoms necessary to complete a 5 - or 6 - member heterocyclic moiety, and p is an integer from 1 to 3; and Z is a photographically acceptable counterion.

10. The film unit as defined in claim 9 wherein said quaternary pyridinium compound is present in said aqueous alkaline processing composition.

11. The film unit as defined in claim 9 wherein said image-receiving layer is located in said second sheet-like element.

12. The film unit as defined in claim 11 further including a strip-coat layer overlying said image-receiving layer.

13. The film unit as defined in claim 9 wherein said photosensitive element includes an image dye-providing material in association with said silver halide emulsion layer.

14. The film unit as defined in claim 13 wherein said photosensitive element comprises a support carrying a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

15. The film unit as defined in claim 13 wherein said quaternary pyridinium compound is represented by the formula

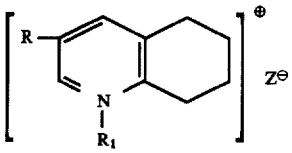

wherein R, $R_1$, and Z are as previously defined.

16. The film unit as defined in claim 13 wherein said quaternary pyridinium compound is represented by the formula

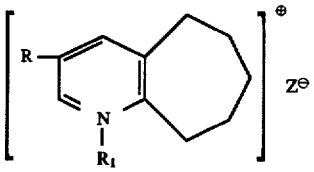

wherein R, $R_1$, and Z are as previously defined.

17. The film unit as defined in claim 9 wherein $R_1$ is $C_2H_5$.

18. The film unit as defined in claim 17 wherein Z is

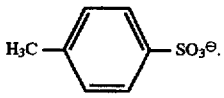

* * * * *